US007984866B2

(12) United States Patent
Cymerman et al.

(10) Patent No.: US 7,984,866 B2
(45) Date of Patent: Jul. 26, 2011

(54) RELOCATABLE OIL SAND SLURRY PREPARATION SYSTEM

(75) Inventors: George J. Cymerman, Edmonton (CA); Khaled Helmy Obaia, Edmonton (CA); Stewart Alexander Johnson, Edmonton (CA)

(73) Assignees: Canadian Oil Sands Limited Partnership, Calgary (CA); Canadian Oil Sands Limited, Calgary (CA); Conocophillips Oils Sands Partnership II, Calgary (CA); Imperial Oil Resources, Calgary (CA); Mocal Energy Limited, Tokyo (JP); Nexen Inc., Calgary (CA); Murphy Oil Company Ltd., Calgary (CA); Petro-Canada Oil and Gas, Calgary (CA)

( * ) Notice: Subject to any disclaimer, the term of this patent is extended or adjusted under 35 U.S.C. 154(b) by 1098 days.

(21) Appl. No.: 11/162,819

(22) Filed: Sep. 23, 2005

(65) Prior Publication Data

US 2007/0068769 A1 Mar. 29, 2007

(51) Int. Cl.
*B02C 23/08* (2006.01)

(52) U.S. Cl. ..... 241/79.3; 241/183; 241/284; 241/299; 241/DIG. 38

(58) Field of Classification Search ..... 241/79.2, 241/79.3, 183, 299, 284, 79, 81, DIG. 30, 241/DIG. 38

See application file for complete search history.

(56) References Cited

U.S. PATENT DOCUMENTS

| | | | | | |
|---|---|---|---|---|---|
| 3,180,581 | A | * | 4/1965 | Velcheff | 241/79 |
| 3,942,644 | A | * | 3/1976 | Vissers | 209/683 |
| 4,013,233 | A | * | 3/1977 | Nylund | 241/80 |
| 4,018,567 | A | * | 4/1977 | La Point | 422/209 |
| 4,055,487 | A | | 10/1977 | Moori | |
| 4,160,718 | A | | 7/1979 | Rendall | |
| 4,225,094 | A | | 9/1980 | Halldorson et al. | |
| 4,252,642 | A | | 2/1981 | Mohri | |
| 4,254,878 | A | | 3/1981 | Marsh | |
| 4,267,980 | A | * | 5/1981 | LaPoint | 241/20 |
| 4,280,879 | A | | 7/1981 | Taciuk | |
| 4,775,284 | A | | 10/1988 | Musschoot | |
| 4,926,601 | A | * | 5/1990 | Musschoot | 451/113 |
| 4,974,781 | A | * | 12/1990 | Placzek | 241/17 |
| 4,995,561 | A | * | 2/1991 | Yukimi | 241/62 |
| 5,108,584 | A | | 4/1992 | Brosseuk | |

(Continued)

FOREIGN PATENT DOCUMENTS

CA 2000984 11/1994

(Continued)

*Primary Examiner* — Bena Miller
(74) *Attorney, Agent, or Firm* — Bennett Jones LLP

(57) ABSTRACT

A relocatable oil sand slurry preparation system is provided for preparing an aqueous oil sand slurry amenable to pipeline conveyance while producing minimum overall rejects, comprising (a) a relocatable rotary digester for slurrying oil sand and water and digesting oil sand lumps to form a pumpable slurry, the rotary digester having a feed end for receiving oil sand and water, a slurrying chamber comprising a plurality of lifters for slurrying the oil sand and water, and a trommel screen end for screening out oversize rejects from the oil sand slurry which falls through the trommel screen; and (b) a relocatable rejects recirculation unit operably associated with the rotary digester for receiving oversize rejects and delivering the rejects back to the rotary digester for further digestion. In a preferred body, relocatable oil sand slurry preparation system further comprises a rejects crusher for crushing oversize rejects prior to delivering rejects back to the rotary digester.

6 Claims, 6 Drawing Sheets

U.S. PATENT DOCUMENTS 5,264,118 A 11/1993 Cymerman et al.
5,433,849 A 7/1995 Zittel
5,480,566 A 1/1996 Strand
5,645,714 A 7/1997 Strand
5,723,042 A 3/1998 Strand
5,794,865 A * 8/1998 Didion et al. ..... 241/74
5,822,881 A * 10/1998 Romweber et al. ..... 34/136
5,829,693 A * 11/1998 Schenk et al. ..... 241/72
6,129,520 A * 10/2000 Cooper ..... 417/234
6,220,536 B1 * 4/2001 Isaji et al. ..... 241/171
6,499,727 B1 12/2002 Sylvester

FOREIGN PATENT DOCUMENTS

CA 2092121 12/1994
CA 2235938 10/1998

* cited by examiner

RELOCATABLE OIL SAND SLURRY PREPARATION SYSTEM

The present invention relates generally to a relocatable oil sand slurry preparation system. More specifically, the relocatable oil sand slurry preparation system comprises a relocatable rotary digester for forming an oil sand slurry free of oversize rejects and a relocatable rejects recirculation unit for receiving the oversize rejects and delivering the rejects back to the rotary digester for further digestion therein. Preferable, relocatable oil sand slurry preparation system further comprises a rejects crusher for crushing oversize rejects prior to delivering them back to the rotary digester.

BACKGROUND OF THE INVENTION

Oil sand, such as is mined in the Fort McMurray region of Alberta, generally comprises water-wet sand grains held together by a matrix of viscous bitumen. It lends itself to liberation of the sand grains from the bitumen, preferably by slurrying the oil sand in heated process water, allowing the bitumen to move to the aqueous phase.

For many years, the bitumen in the McMurray sand has been commercially removed from oil sand using what is commonly referred to in the industry as the "hot water process". The oil sand is strip-mined and conveyed on belt conveyors, often several kilometres in length, to an extraction plant. At the extraction plant, the oil sand is mixed with hot water (95° C.) and a small amount of caustic in a rotating horizontal drum or tumbler, where oil sand conditioning occurs. Here, the larger lumps of oil sand are ablated or digested and the released bitumen flecks coalesce and attach to air bubbles (referred to as "conditioning"). On leaving the tumbler, the conditioned slurry is diluted with additional hot water and retained under quiescent conditions for a prolonged period in a primary separation vessel ("PSV"), where the bitumen forms a froth that rises to the top of the vessel.

However, use of belt conveyors extending from the mine site to the extraction plant produced a number of problems. First, belt conveyors are expensive to install, operate and maintain. Further, as the mining area increases in the Fort McMurray region, the location of mining faces became more and more remote from the extraction plant, requiring more and longer belt conveyors to transport the mined oil sand.

The introduction of a pipeline to convey an aqueous slurry of the oil sands from the mine site to the extraction plant was a major advancement in the art. Surprisingly, it was found that much of the oil sand slurry conditioning takes place during transport of the slurry through the pipeline. Hence, the pipelined slurry could be fed directly to the PSV, thereby eliminating the need for large tumblers at the extraction plant. Nevertheless, the oil sand must still be satisfactorily blended with heated water at the mine site to produce a slurry capable of being conveyed through a pipeline (referred to as "pumpable slurry") for transport and conditioning therein.

One slurry preparation system for producing pumpable slurry is referred to as the mixer circuit and is taught in Canadian Patent No. 2,000,984 and U.S. Pat. No. 5,264,118. The stationary mixer circuit comprises a vertically oriented mixer vessel forming a cylindrical, open-topped mixing chamber. A vortex is formed in the mixing chamber by tangentially feeding recycled slurry and to this rotating vortex is added oil sand and fresh water. However, the residence time in the mixer circuit is short (e.g., less than 30 seconds), resulting in a higher than desirable number of larger oil sand lumps, which are incapable of being pumped through the pipeline, and as such have to be removed. Further, the mixer circuit is very large and not amenable to being readily moved.

There is a need for an efficient oil sand slurry preparation system comprising a slurry preparation means for suitably digesting oil sand lumps to produce a pumpable oil sand slurry and a means for recycling oversize rejects, which rejects include large oil sand lumps, back to the slurry preparation means for further digestion, thereby reducing the overall amount of oversize rejects remaining. Preferably, the system is relocatable and can be periodically moved from location to location as the mine face advances.

Thus, the present invention is directed towards a relocatable oil sand slurry preparation system, which satisfactorily blends the oil sand with heated water to yield a consistent, dense (e.g., 1.5-1.65 g/cc), aerated oil sand slurry that is amenable to pipeline conveyance while substantially reducing the overall amount of oversize rejects.

SUMMARY OF THE INVENTION

In accordance with the invention, a relocatable rotary digester is provided for producing an aqueous oil sand slurry amenable to pipeline conveyance (i.e., a pumpable slurry), comprising:

- a rotatable drum arranged for rotation about a substantially longitudinal axis of the drum, said rotatable drum having a feed end for receiving oil sand and water, a slurrying chamber for slurrying the oil sand and water and digesting oil sand lumps, and a trommel or cylindrical screen end for screening out oversize lumps of oil sand, rocks, lumps of clay and the like from oil sand slurry which falls through the trommel screen;
- a plurality of lifters longitudinally arranged in the slurrying chamber for lift-drop crushing and ablating oil sand lumps during slurrying; and
- a drive means operably engaged with the rotatable drum for rotating the rotatable drum about the substantially longitudinal axis of the drum.

By "pumpable slurry" is meant an aerated oil sand and water slurry having a density of about 1.4 to about 1.65 g/cc which is devoid of any material having any dimension greater than about 2" to about 4", such as oil sand lumps, rocks, lumps of clay and the like.

By "rejects" or "oversize rejects" is meant undigested oil sand lumps and other material such as rocks, clay lumps and the like, all of which have a dimension greater than about 2" to about 4".

The relocatable rotary digester provides a retention time for the oil sand and water in the slurrying chamber that is sufficiently long to assure adequate oil sand lump digestion/ablation. Residence time is preferably 1 minute or longer.

In one embodiment, the relocatable rotary digester further comprises propulsion means such as crawlers, flat skids or wheels for assisting in the relocation of the digester closer to the mine face as the mine face progresses.

In another embodiment, the relocatable rotary digester further comprises a plurality of ejectors arranged in the slurrying chamber of the rotatable drum near the trommel screen end for assisting in the removal of oil sand slurry and ejecting oversize rejects from the drum, said ejectors preferably comprising a plurality of individual scoop flights.

In another embodiment, the internal lifters are perforated for sifting preferably larger lumps and aerating the oil sand slurry.

Further in accordance with the invention, an oil sand slurry preparation system is provided for preparing a pumpable oil sand slurry while producing minimum overall rejects, comprising:

a slurry preparation means for slurrying oil sand and water and digesting oil sand lumps, said slurry preparation means comprising means for screening out oversize rejects to produce pumpable oil sand slurry; and a rejects recirculation unit operably associated with the slurry preparation means for receiving oversize rejects and delivering said rejects back to the slurry preparation means for further digestion.

In a preferred embodiment, the oil sand slurry preparation system further comprising a crushing means or impactor for crushing and comminuting the screened rejects prior to delivering them back to the rotary digester.

In one embodiment, the rejects recirculation unit of the oil sand slurry preparation system comprises a plurality of belt conveyors. In another embodiment, the rejects recirculation unit comprises a spiral lift pump.

In another embodiment, a relocatable oil sand slurry preparation system is provided for preparing a pumpable oil sand slurry while producing minimum overall rejects, comprising:

a relocatable rotary digester for slurrying oil sand and water to form a pumpable oil sand slurry, said rotary digester having a feed end for receiving the oil sand and water, a slurrying chamber comprising a plurality of lifters for slurrying the oil sand and water and digesting oil sand lumps, and a trommel screen end for screening out oversize rejects from the oil sand slurry which falls through the trommel screen; and a relocatable rejects recirculation unit operably associated with the rotary digester for receiving oversize rejects and delivering said rejects back to the rotary digester for further digestion.

In a preferred embodiment, the relocatable oil sand slurry preparation system of the present invention further comprises a crushing means or impactor for crushing and comminuting the screened rejects to a smaller size prior to delivering them back to the rotary digester.

In one embodiment, the rejects recirculation unit comprises a plurality of belt conveyors. In another embodiment, the rejects recirculation unit comprises a spiral lift pump.

In a further preferred feature, the relocatable oil sand slurry preparation system further comprises a metal detector for detecting any metal objects in the screened rejects, such as broken teeth from oil sand excavating shovels, prior to recirculating the rejects via the rejects recirculation unit back to the rotary digester.

In a preferred embodiment, the relocatable oil sand slurry preparation system further comprises a pump box positioned beneath the trommel screen end for receiving the pumpable slurry. The pump box is connected to a pump, which pumps the oil sand slurry through a pipeline of sufficient length to further condition the slurry.

The mined dry oil sand is preferably delivered to the rotary digester of the relocatable oil sand slurry preparation system from the mine site by means of a plurality of belt conveyors. In one embodiment, the mined dry oil sand is first conveyed to a mixing box operably associated with the rotary digester. Water is then added to the mixing box and the water and oil sand mixture is delivered to the rotary digester for further slurrying and lump ablation in the slurrying chamber.

DESCRIPTION OF THE PREFERRED EMBODIMENT

Figure 1:
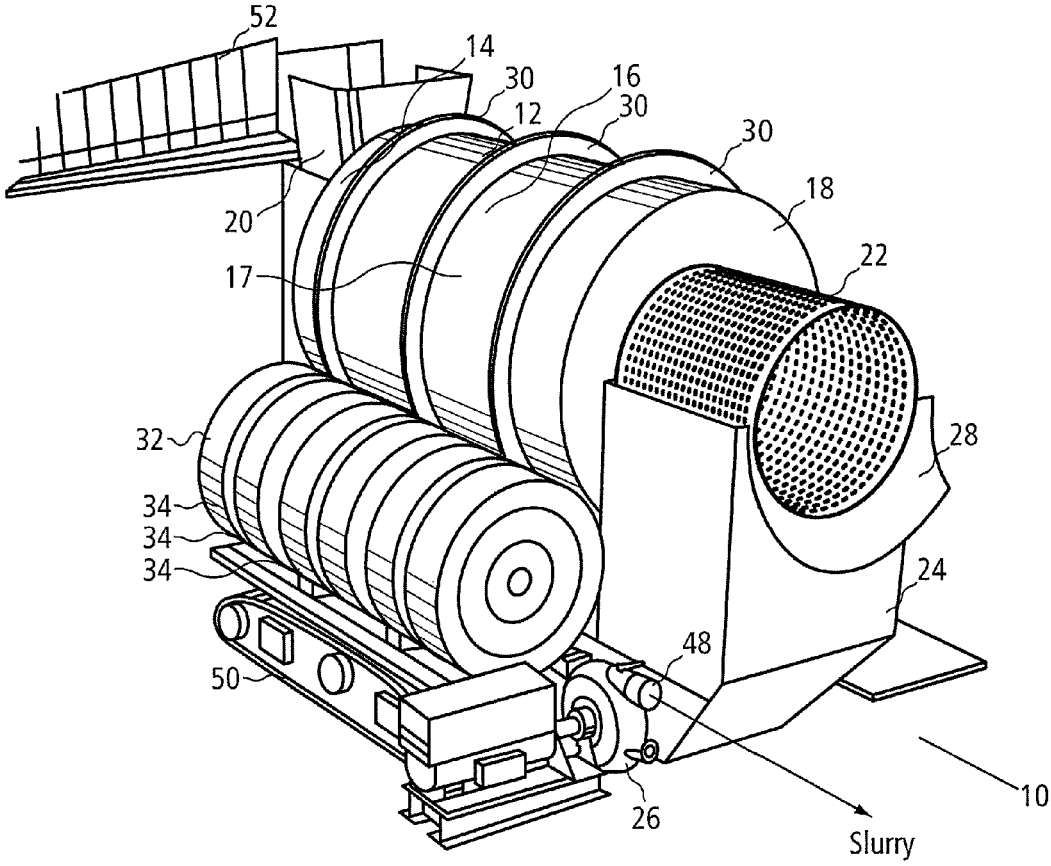
FIG. 1 is a perspective view of the relocatable rotary digester in accordance with an embodiment of the invention.
Figure 4A:
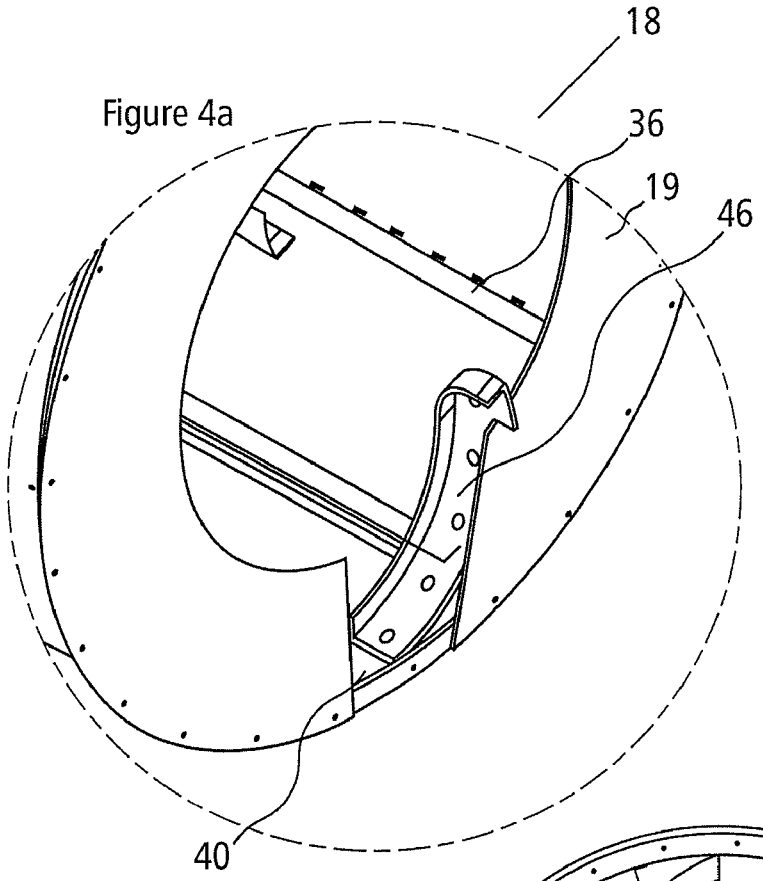
FIGS. 4*a* and 4*b* show rock ejectors of the present invention, wherein 4*a* is a frontal view of the discharge end of the rotary digester where trommel screen has been removed to show rock ejectors and 4*b* is a cross-sectional view of the rotary digester showing the rock ejectors.

An embodiment of a slurry preparation means of the slurry preparation system according to the invention is illustrated in FIG. 1. In this embodiment, the slurry preparation means is a rotary digester generally designated 10, which comprises a rotatable drum arranged for rotating about a substantially longitudinal axis of the drum. Rotatable drum 12 comprises a feed end 14, a slurrying chamber 16 comprising a cylinder 17 having a substantially non-perforated wall, which non-perforated wall 19 can be more clearly seen in FIG. 2, and a discharge end 18. In a preferred embodiment, as shown in FIG. 4*a*, discharge end 18 comprises a lip 19 for controlling the flow of oil sand slurry from the rotary digester 10.

Operably associated with feed end 14 of drum 12 is a mixing box 20 where mined dry oil sand and water are first pre-mixed. Mined dry oil sand is delivered to mixing box 20 by means of feed conveyor 52. The oil sand/water mixture from the mixing box 20 is then delivered to rotatable drum 12 via feed end 14 and tumbled within slurrying chamber 16 of rotatable drum 12 for further slurrying and processing/digestion of larger lumps of oil sand to produce oil sand slurry.

Figure 4B:
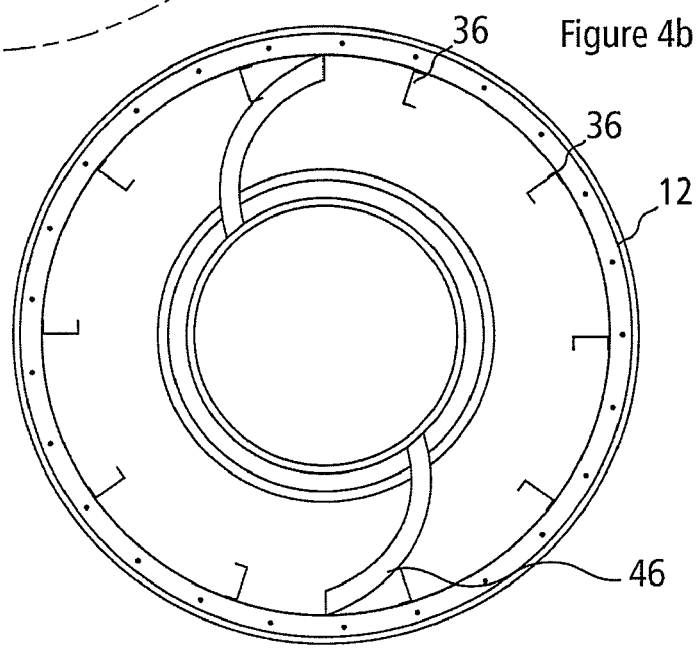
Figure 5:
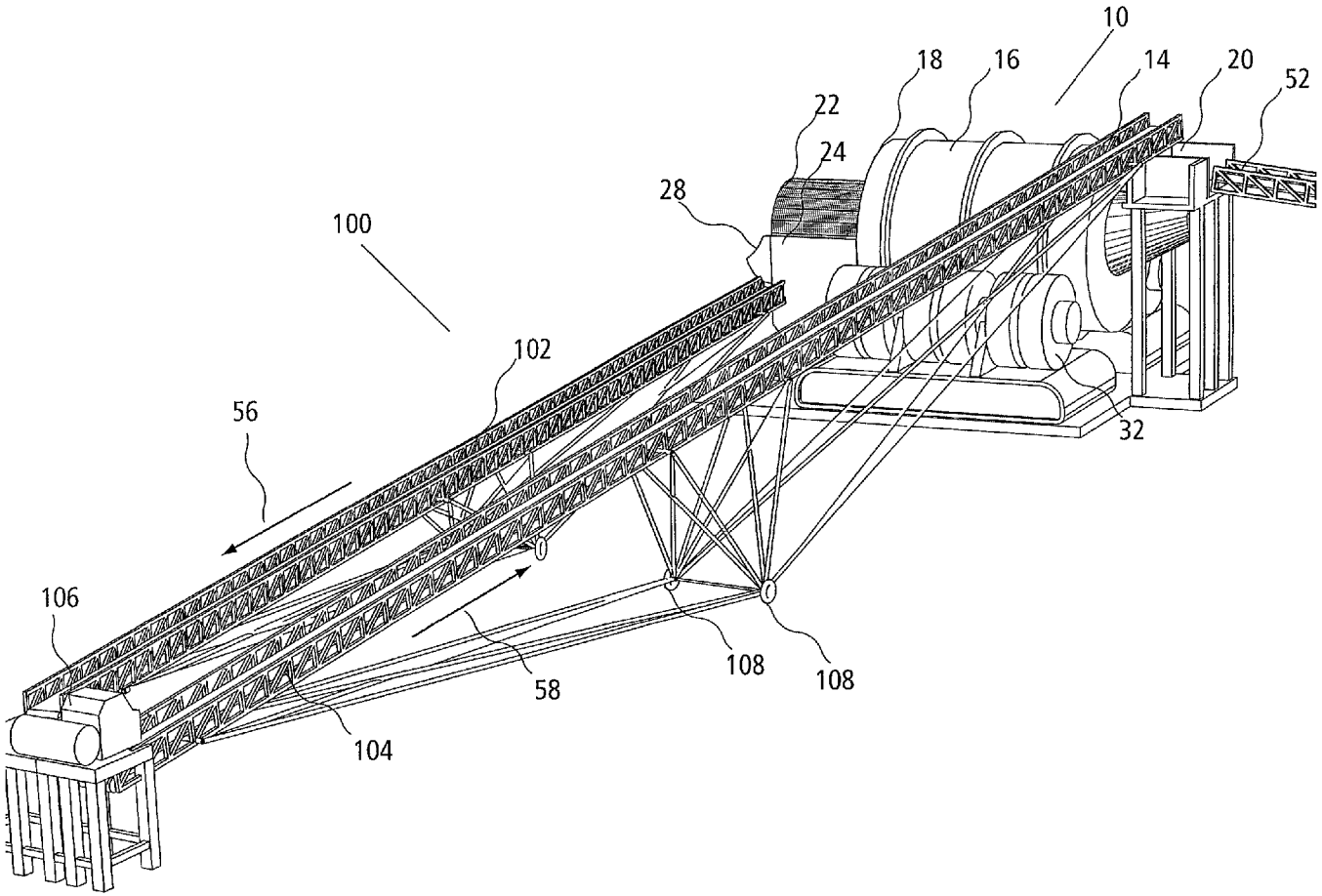
FIG. 5 is a perspective view of one embodiment of the oil sand slurry preparation system comprising belt conveyors and an impactor crusher.

Discharge end 18 of rotatable drum 12 further comprises a trommel screen 22 for screening out any oversize oil sand lumps (e.g., lumps greater that about 2" to about 4" in any dimension) and other rejects still remaining in the oil sand slurry. Screened oil sand slurry (which is now referred to as pumpable slurry) is collected in pump box 24 and is pumped via pump 26 to pipeline 48 for further conditioning. In one embodiment, trommel screen 22 further comprises rejects chute 28, which directs oversize lumps or rejects either to a discharge pile (not shown) or to a rejects recirculation unit as illustrated in FIGS. 4 and 5.

Surrounding the outer circumference of rotatable drum 12 is a plurality of steel riding rings 30 that bear against tire drive means 32. Tire drive means 32 comprises a plurality of rubber tires 34 and a drive means (not shown) and operates to rotate the rotatable drum along its horizontal axis. In one embodiment, crawlers 50, located underneath the rotary digester support frame, assist in the relocation of the digester closer to the mine face as the mine face progresses. In another embodiment (not shown), the rotary digester is mounted on a flat skid allowing the entire structure to be lifted and relocated. It is understood that other propulsion means could also be used such as wheels.

Figure 2:
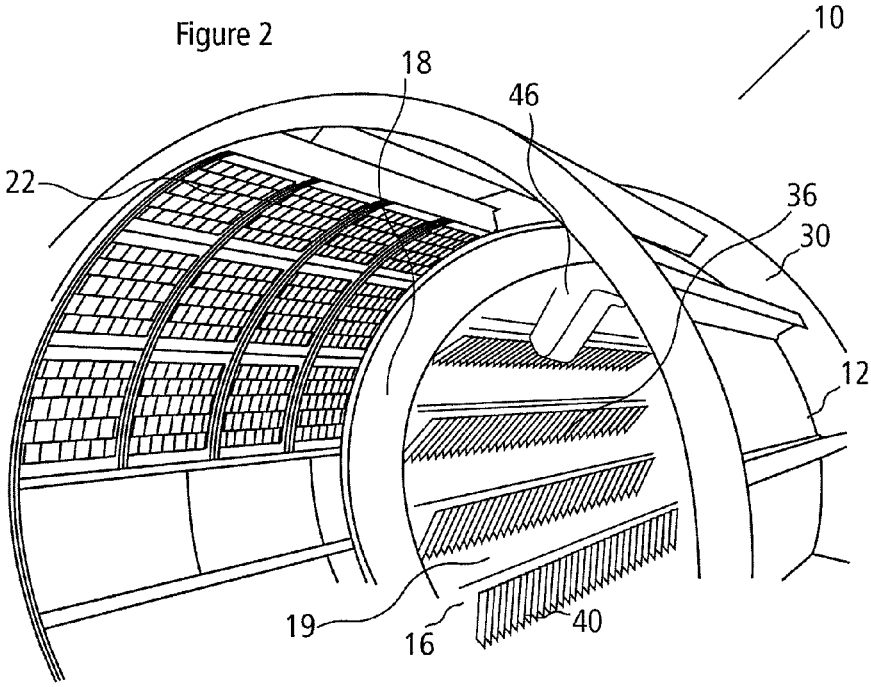
FIG. 2 shows the interior of the rotatable drum of the rotary digester to display internal lifters, rock ejectors and trommel screen.

With reference now to FIG. 2, which shows the inside of rotatable drum 12, a plurality of lifters 36 are arranged longitudinally within the slurrying chamber 16 of rotatable drum 12 for lifting and dropping oil sand lumps as the drum rotates so that most of the oil sand lumps will be broken, ablated and digested. The rotary digester is designed such that the residence time of the slurry in the rotatable drum 12 is in the order of about one to about three minutes, or longer.

Figure 3:
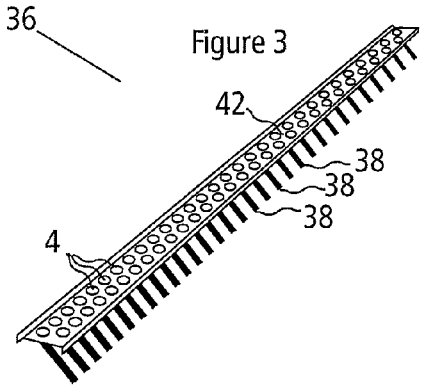
FIG. 3 is a perspective view of one of the perforated lifters.

Each lifter 36 comprises a plurality of gussets 38 mounted to the interior wall 40 of the slurrying chamber 16 of drum 12, preferably at about a 45° angle, and a perforated plate 42 that is attached along its length to the free end of each gusset 38, as shown in FIG. 3. The perforated plate 42 comprises a plurality of perforations 44, which are each about 4 inches in diameter and operate to selectively lift and drop lumps that are larger than 4 inches and to aerate the oil sand slurry each time the slurry contacts the perforated bar 42.

Rotatable drum 12 further comprises a plurality of rock ejectors 46 attached to the interior wall 40 of the rotatable drum 12 near its discharge end 18, as shown in FIG. 2. The rock ejectors 46, shown in more detail in FIGS. 4*a* and 4*b*, are comprised of scoop-like, curved projections which operate to pick up oil sand slurry and large lumps and rocks, and direct these materials out of the rotatable drum onto the trommel screen so that the trommel screen receives substantially the entirety of the contents of the rotatable drum.

In operation, most oil sand lumps are digested in the rotary digester due to the effective multiple lifting/dropping, lump ablation and collateral attrition. Thus, the number of primary oversize rejects is reduced as compared to conventional slurry preparation units.

FIG. 5 shows one embodiment of the relocatable oil sand slurry preparation system of the present invention comprising rotary digester 10 and one embodiment of a rejects recirculation unit, said rejects recirculation unit generally designated 100. Rejects recirculation unit 100 is operably associated with the rotary digester 10 for receiving rejects and delivering the rejects back to the rotary digester to be digested again. In this embodiment, rejects recirculation unit 100 comprises two belt conveyors, impactor feed conveyor 102, which is reversible, and impactor discharge conveyor 104.

Rejects are deposited onto impactor feed conveyor 102 by means of rejects chute 28. Impactor feed conveyor 102 travels in the direction shown by arrow 56 and deposits the rejects into impact crusher or impactor 106, where the rejects are crushed to a smaller size. The crushed rejects are then deposited onto impactor discharge conveyor 104 travelling in the direction shown by arrow 58 and delivered back to rotary digester 10. In a preferred embodiment, the crushed rejects are first deposited into mixer box 20 where the crushed rejects are mixed with oil sand and water prior to being fed into the rotary digester 10.

Impactor feed conveyor 102 can be equipped with a metal detector (not shown), which operates to protect the impactor 106 from metal objects that may be mixed in with the rejects. The direction of travel of the impactor feed conveyor 102, which is normally towards the impactor 106 as shown by arrow 56, will be reversed when the metal detector detects a metal object. Hence, the metal object can be discarded, along with a small quantity of rejects, thereby protecting the impactor 106 from damage that could be caused by the metal object.

Rejects recirculation unit 100 further comprises a plurality of wheels 108 which allow the unit to be relocatable, depending upon the location of the mine site.

Thus, in operation, oil sand is delivered to mixer box 20 via feed conveyor 52. Preferably, heated water is added to mixer box 20 to pre-mix the oil sand with water. The oil sand and water is then delivered to the rotary digester 10 via feed end 14 and the oil sand and water is slurried in slurry chamber 16 with the assistance of a plurality of internal lifters. Oil sand slurry exits via discharge end 18 with the assistance of rock ejectors and the slurry is delivered onto the internal surface of trommel screen 22 where rejects are screened out from the pumpable oil sand slurry which falls through the trommel screen.

Pumpable oil sand slurry passes through trommel screen 22 into pump box 24 and is pumped via a pump through a pipeline for further conditioning. Rejects remaining on the inside surface of trommel screen 22 are delivered via rejects chute 28 to impactor feed conveyor 102. Conveyor 102 then delivers the rejects to impactor 106 where rejects are crushed and comminuted to smaller size. Crushed rejects are then deposited onto impactor discharge conveyer 104 and delivered back to the mixer box 20 for further digestion in the rotary digester 10.

Figure 6:
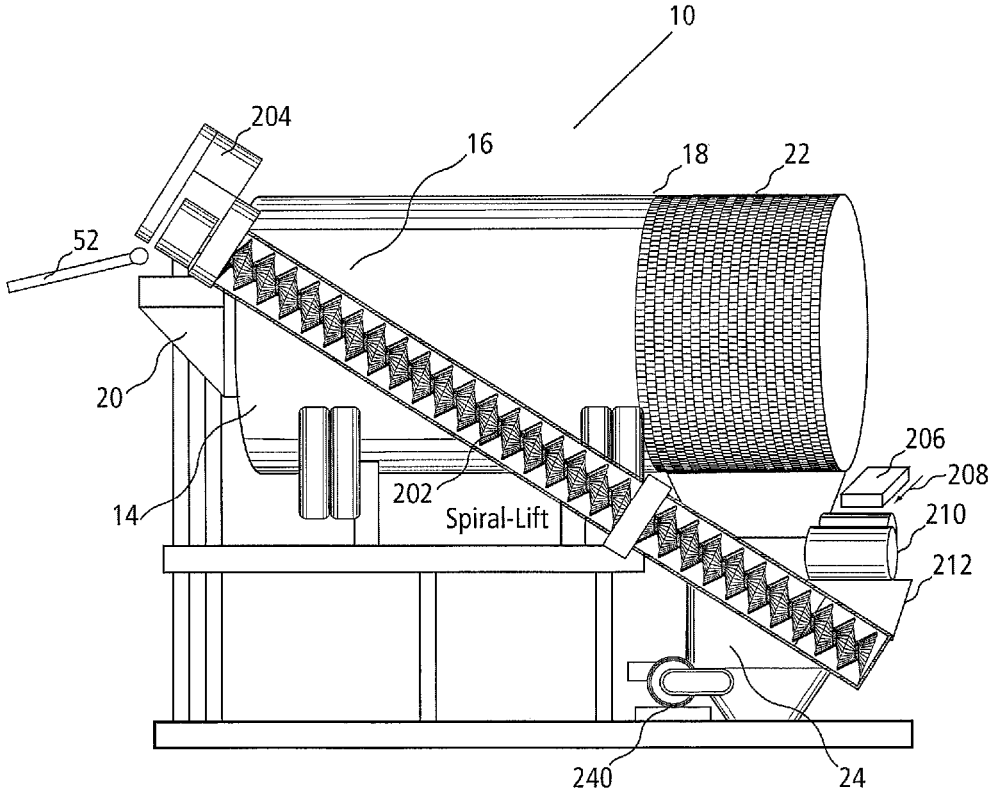
FIG. 6 is a perspective view of another embodiment of the oil sand slurry preparation system comprising a shuttle conveyor, metal detector, reject crusher and spiral lift pump.

FIG. 6 shows another embodiment of the relocatable oil sand slurry preparation system of the present invention comprising rotary digester 10 and another embodiment of a rejects recirculation unit, which is generally designated 200. Rejects recirculation unit 200 is operably associated with the rotary digester 10 for receiving rejects and delivering the rejects back to the rotary digester to be digested again. In this embodiment, rejects recirculation unit 200 comprises a spiral lift 202 operated by variable speed drive 204.

Oversize lumps or rejects, which do not pass through trommel screen 22, drop onto shuttle conveyor 206, a reversible conveyor, travelling in a forward direction as indicated by arrow 208. Rejects are then dropped into reject crusher or impactor 210, which in this embodiment comprises double rollers, crushed to a smaller size and the crushed rejects are then dropped into crushed reject sump 212, where water is added to produce a dense slurry of crushed rejects and water. Operably associated with reject sump 212 is spiral lift 202, which rotates by means of drive means 204.

In a preferred embodiment, shuttle conveyor 206 is equipped with a metal detector (not shown) to protect the impactor 210 from receiving metal objects that may be mixed in with the rejects. The direction of travel of the shuttle conveyor 206, which normally is in the direction as shown by arrow 208, will be reversed when the metal detector detects a metal object. Hence, the metal object, along with a small pile of rejects, can be discarded and thus protect the impactor 210 from damage. Alternatively, a mechanically operated flip-chute may be used to discharge a metal object with a small quantity of reject outside the crusher.

Thus, in operation, oil sand is delivered to mixer box 20 via feed conveyor 52. Preferably, heated water is added to mixer box 20 to pre-mix the oil sand with water. The oil sand and water is then delivered to the rotary digester 10 via feed end 14 and the oil sand and water is slurried in slurry chamber 16 with the assistance of a plurality of internal lifters. Oil sand slurry exits via discharge end 18 with the assistance of rock ejectors and the slurry is delivered onto the internal surface of trommel screen 22 where rejects are screened from the pumpable oil sand slurry.

Pumpable oil sand slurry passes through trommel screen 22 into pump box 24 and is pumped via pump 240 through a pipeline for further conditioning. Rejects remaining on the inside surface of trommel screen 22 are dropped onto shuttle conveyor 206. Conveyor 206 then delivers the rejects to a crusher/impactor 210 where rejects are crushed and comminuted to smaller size. Crushed rejects are then deposited into crushed reject sump 212 and water is added to form a crushed rejects slurry. Spiral lift 202, which is rotated by drive means 204, delivers crushed rejects slurry back to the mixer box 20 for further digestion in the rotary digester 10.

Figure 7:
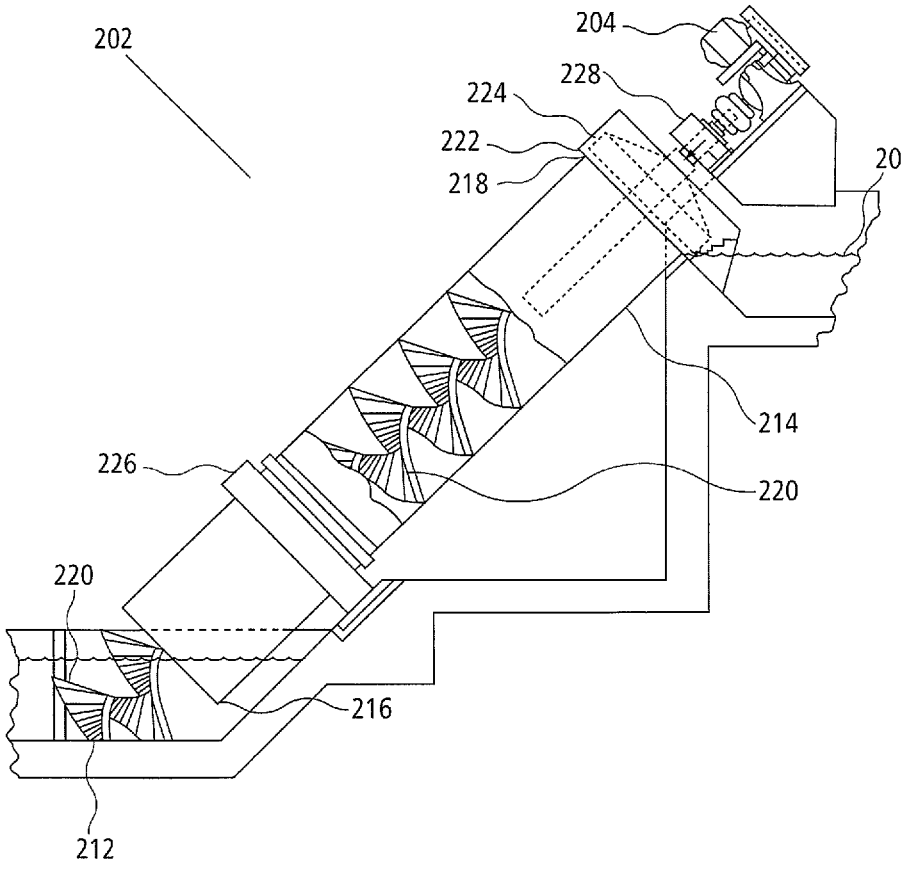
FIG. 7 is a perspective view of the spiral lift of FIG. 6 showing part of the cylinder wall broken away to display the internal screw.

A side view of spiral lift 202 is shown in FIG. 7. Spiral lift 202 is an Archimedes screw and comprises cylinder 214 having an open bottom end 216 and a top end 218 and an integral, primarily internal, single-pitch helical auger or spiral screw 220. The spiral lift 202 is designed to be able to "pump" or lift slurries ranging in densities from about 1.44 to about 1.78 kg/litre (70% solids concentration by mass). The helical flights of spiral screw 220 are oriented perpendicularly to the cylinder wall and are continuously welded to the interior surface of cylinder 214 to give a single, rigid, revolving unit.

Top end 218 further comprises a labyrinth seal 222 and anti-splatter containment 224. Spiral lift 202 further comprises support bearings 226 and 228 at the lower and upper ends of the spiral lift 202, respectively. The lower support 226 comprises a garland of rollers for supporting the rotating cylinder 214 and preventing it from accidental lifting, but still allowing it the axial movement. The upper support 228 comprises a thrust bearing to support the main shaft of cylinder 214 both vertically and axially. Spiral lift 202 further comprises drive means 204, which is located at the upper end of spiral lift 202, for rotating the cylinder 214.

The bottom portion of screw 220 extends past open bottom end 216 and is submerged in the relatively dense slurry of crushed rejects and water, which is present in crushed reject sump 212. The exposed portion of screw 220 acts as an inducer to mix the crushed rejects with water and feed the crushed rejects slurry to the spiral lift 202, which then lifts it further into mixing box 20. As the spiral lift rotates, the slurry from the sump 212 fills the pockets formed between the bottom end 216 of the cylinder 214 and the helical spiral flights. Although there is no relative movement between the spiral screw 220 and the cylinder 214, the geometry of the rotating spiral lift causes slurry pockets to travel up the cylinder and discharge at the top end 218 of cylinder 214. The pumping rate is proportional to the rotational speed, up to a point at which centrifugal forces start to interfere with the slurry settling within the pockets.

Use of the spiral lift 202 to return crushed, oversize reject slurry to the rotary digester allows for construction of smaller, more compact oil sand slurry preparation units, with the added advantage of extended digestion of oil sand lumps and the ability to be relocated closer to the mine site as the mine site advances.

What is claimed is:

1. An apparatus for producing a pumpable aqueous oil sand slurry, comprising:

a rotary digester consisting essentially of:

a rotatable drum having a first end and a second end and arranged for rotation about a substantially longitudinal axis of the drum, said rotatable drum consisting essentially of a feed inlet at the first end of the rotatable drum for receiving oil sand and water and a cylindrical slurrying chamber having a substantially non-perforated wall for slurrying the oil sand and water and digesting oil sand lumps, a trommel screen at the second end of the rotatable drum for receiving substantially the entirety of the contents of the rotatable drum and screening out oversize rejects from the oil sand slurry that falls through the trommel screen, said trommel screen having an outlet for discharging oversize rejects, and a drive means operably engaged with the rotatable drum for rotating the rotatable drum about the substantially longitudinal axis of the drum; and a pump box for receiving the oil sand slurry as it falls through the trommel screen;

thereby producing the pumpable aqueous oil sand slurry.

2. The apparatus as claimed in claim 1 further comprising a rejects chute positioned at the outlet of the trommel screen.

3. An apparatus for producing a pumpable aqueous oil sand slurry, comprising:

a rotary digester consisting essentially of:

a rotatable drum having a first end and a second end and arranged for rotation about a substantially longitudinal axis of the drum, said rotatable drum consisting essentially of a feed inlet at the first end of the rotatable drum for receiving oil sand and water, a cylindrical slurrying chamber having a substantially non-perforated wall for slurrying the oil sand and water and digesting oil sand lumps, and a plurality of lifters longitudinally arranged in the cylindrical slurrying chamber for lifting and drop-crushing oil sand lumps during slurrying, a trommel screen at the second end of the rotatable drum for receiving substantially the entirety of the contents of the rotatable drum and screening out oversize rejects from the oil sand slurry that falls through the trommel screen, said trommel screen having an outlet for discharging oversize rejects, and a drive means operably engaged with the rotatable drum for rotating the rotatable drum about the substantially longitudinal axis of the drum; and a pump box for receiving the oil sand slurry as it falls through the trommel screen;

thereby producing the pumpable aqueous oil sand slurry.

4. The apparatus as claimed in claim 3, wherein the lifters are perforated for aerating the oil sand slurry.

5. The apparatus as claimed in claim 3 further comprising a rejects chute positioned at the outlet of the trommel screen.

6. An apparatus for producing a pumpable aqueous oil sand slurry, comprising:

a rotary digester consisting essentially of:

a rotatable drum having a first end and a second end and arranged for rotation about a substantially longitudinal axis of the drum, said rotatable drum consisting essentially of a feed inlet at the first end of the rotatable drum for receiving oil sand and water, a cylindrical slurrying chamber having a substantially non-perforated wall for slurrying the oil sand and water and digesting oil sand lumps, and a plurality of ejectors arranged in the cylindrical slurrying chamber for assisting in the removal of oil sand slurry and rejects from the rotatable drum, a trommel screen at the second end of the rotatable drum for receiving substantially the entirety of the contents of the rotatable drum and screening out oversize rejects from the oil sand slurry that falls through the trommel screen, said trommel screen having an outlet for discharging oversize rejects, and a drive means operably engaged with the rotatable drum for rotating the rotatable drum about the substantially longitudinal axis of the drum; and a pump box for receiving the oil sand slurry as it falls through the trommel screen;

thereby producing the pumpable aqueous oil sand slurry.

* * * * *